United States Patent [19]

Kellogg et al.

[11] Patent Number: 4,708,073

[45] Date of Patent: Nov. 24, 1987

[54] METHOD FOR PROCESSING FABRIC PIECES IN A CUT AND SEW OPERATION

[75] Inventors: Robert L. Kellogg, Greensboro; Roger W. Zimmerman, Liberty, both of N.C.; Carney J. Bryan, St. Augustine, Fla.

[73] Assignee: Blue Bell, Inc., Greensboro, N.C.

[21] Appl. No.: 931,703

[22] Filed: Nov. 14, 1986

[51] Int. Cl.[4] ..... D05B 21/00; D05B 97/00

[52] U.S. Cl. ..... 112/262.3; 112/121.15; 198/346.1; 198/465.1

[58] Field of Search ..... 112/262.3, 262.1, 121.15, 112/121.12; 198/346.1, 465.1, 803.01

[56] References Cited

U.S. PATENT DOCUMENTS

| | | | |
|---|---|---|---|
| 3,204,756 | 9/1965 | Lesch | 198/465.1 |
| 3,721,202 | 3/1973 | Dodsworth | 112/121.15 X |
| 4,485,754 | 12/1984 | MacDonald | 112/121.15 X |
| 4,598,817 | 7/1986 | Bell, Jr. et al. | 112/262.3 X |
| 4,625,665 | 12/1986 | Engle | 112/262.3 |
| 4,640,162 | 2/1987 | London et al. | 112/262.3 |
| 4,656,949 | 4/1987 | Ragot | 198/465.1 X |

*Primary Examiner*—H. Hampton Hunter

*Attorney, Agent, or Firm*—Chares. R. Rhodes; Judith E. Garmon

[57] ABSTRACT

Fabric pieces or panels are releasably mounted in a unique materials handling clip or cartridge to facilitate handling, identification, storage, transportation, and registration during subsequent sewing operations. The clips are mechanically assembled onto a magazine where both the clips and fabric panels are maintained in spaced relation to each other. A plurality of magazines are mounted on a loader/feeder apparatus which enables the clips to be automatically and sequentially unloaded and fed to a subsequent processing operation, then reloaded into the magazine. The clips permit easy handling and automatic registration of the separate fabric pieces into sewing fixtures for automated sewing and/or assembly operations while maintaining a prescribed sequence.

3 Claims, 11 Drawing Figures

FIG. 6
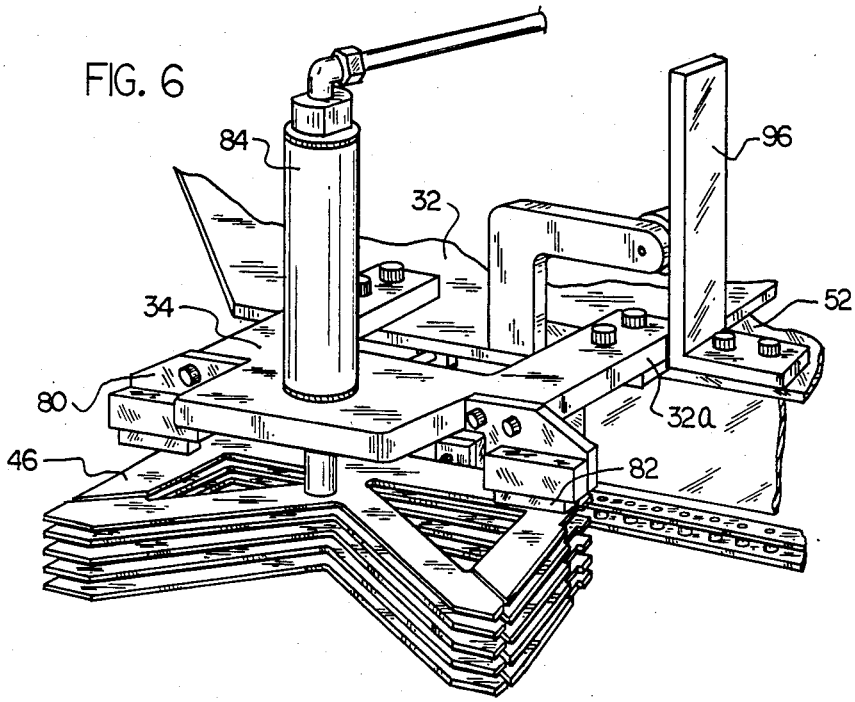
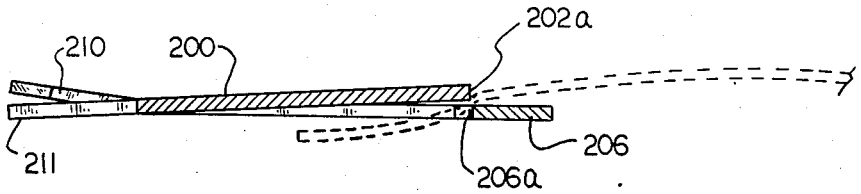
FIG. 11

METHOD FOR PROCESSING FABRIC PIECES IN A CUT AND SEW OPERATION

BACKGROUND OF THE PRESENT INVENTION

This invention is directed to materials handling techniques for the apparel industry, and more particularly to improvements in the manner in which flimsy fabric pieces, such as apparel pockets after once being separated, are stored according to a prescribed sequence, transported, and/or presented to subsequent sewing operations in the forming of apparel products.

During the manufacture of apparel such as trousers, shirts, jackets, sleepwear, and the like, it is conventional practice in the apparel industry to first cut individual parts or components of the garment from a pattern and later sew the parts together to form the completed garment. Such parts include pockets, collars, and other components. Cut fabric pieces are then arranged in stacks, stored, and then transported to the next operation which may be sewing, embroidery, inspection, or the like. Sometimes components such as pockets and collars have fancy stitching, labels, or designs sewed, embroidered, or otherwise affixed thereto prior to the time they are assembled and attached to the next generation assembly.

During such processing it is presently the accepted practice for fabric pieces to be manually separated from a stack of like pieces and at each work station presented to a sewing head, attached to an embroidery frame, presented to a pants leg or other garment part, or otherwise further processed. Such manual handling is recognized to be expensive and laborious. Secondly, where the pieces are subjected to intermediate sewing, embroidery, or other operations, multiple handlings thereof are required. In addition to the expense of manual handling it is very difficult, and often impossible, to maintain the pieces in a prescribed sequence which is very important in modern cut and sew operations as dye lots vary.

For example, in a typical cut and sew operation many stacks of fabric (up to 100) are laid out on a cutting table, then the different parts of the garment are cut. It is recognized practice that a single garment should, if at all possible, come from the same fabric fold to ensure consistency of color throughout the garment. When the individual parts are separated for further processing and the assembly operation in preparation for sewing, it is necessary to reassemble the same parts from the same fabric fold back together at the assembly point. Thus, one can easily see the advantages of being able to maintain fabric pieces in a prescribed sequence.

Further, considerable time is lost in manually selecting and positioning a flimsy fabric piece for subsequent sewing operation. Because of the lack of rigidity of the fabric panel, automatic handling equipment has not been developed to accurately position the fabric merely by picking up and moving the fabric itself. Therefore, it would be advantageous to provide some type of rigid locating edge, hole, or corner arrangement for each fabric piece to ensure proper registration thereof in subsequent assembly operations.

Previously fabric pieces were manually separated because of a lack of automated equipment for reliably removing one panel at a time from a stack of fabric pieces. However, recently a highly reliable fabric ply separator has been developed which makes the automated maintaining of fabric plies as separate items both feasible and desirable. The aforesaid fabric ply separator is described in U.S. patent application Ser. No. 933,469 filed Nov. 21, 1986.

SUMMARY OF THE PRESENT INVENTION

The present invention is, therefore, directed to improvements in the technique for processing fabric pieces in a cut and sew operation. In general, in accordance with the present invention, once the fabric pieces are cut to size they are successively and mechanically presented to a loading station where they are attached to a rigid handling cartridge or clip, to which they remain attached throughout further storage, transportation, and processing until the fabric piece is joined to its next generation apparel assembly or subassembly. The clips are sequentially stacked in a clip magazine where they are maintained in the prescribed sequence, in spaced arrangement, and in a prescribed orientation until they are unloaded from the magazine for the next subsequent operation. In addition to keeping the flimsy fabric pieces separate, identified, and in sequence for subsequent processing, the clips, magazine, and loader/feeder apparatus provide for automated stacking, storing, and handling of the fabric pieces. The clips themselves further provide a positive registration means for accurately positioning the fabric pieces for successive processing thereof.

The rigid clips of the present invention include a body portion having a clamping means extending outwardly therefrom for releasably gripping at least one edge of the fabric panel. Additionally, the body portion includes an attachment means associated therewith for mounting the clips, along with other clips in a storage magazine.

The storage magazine includes, in its preferred form, a U-shaped housing carrying a threaded rod having a feed/delivery end. The attachment means associated with the body portion of the clips are so constructed with relation to the threads of the rods that the rods hold the clips thereon in spaced arrangement. While the clips are mounted in the magazine, the edges of the U-shaped housing maintain the clips at a prescribed orientation during loading therein and the feeding therefrom. The impetus for selectively and intermittently moving the clips along the storage rod is provided by a drive source which rotates the threaded rod one revolution, resulting in the loading or feeding of a single clip.

The loader/feeder apparatus includes, in general, a plurality of stations. At a first station (referred to hereinafter as the empty clip supply station), a stack of empty clips mounted on a magazine are stationed. A transport head removes the clips one at a time and transfers them over to a second position (fabric panel insertion station) where the clip is mechanically activated to the open position for receiving an edge of a fabric panel. Once the fabric piece is in place, the spring clip is released to grip the fabric piece and the transport head then transfers the loaded spring clip eventually into an empty magazine. The process continues until the empty magazine is loaded. The apparatus can be reversed to unload clips containing fabric pieces to subsequent processing stations one at a time and either reload it onto an empty magazine, or have the clip separated from the fabric piece if the fabric panel has been sewn into its next generation assembly or subassembly, at which time the empty clip is then returned to the magazine to form a magazine of empty clips.

It is therefore an object of the present invention to provide an improved system for handling fabric pieces from the time they are initially cut and separated until they are assembled and attached to the next generation assembly in forming an article of apparel.

It is another object of the present invention to provide an improved technique for handling fabric pieces of the type described in which a rigid handling clip is attached to at least one edge of a flimsy fabric panel and maintained in engagement therewith through subsequent processing steps.

It is still another object of the present invention to provide an improved fabric piece handling system of the type described in which fabric pieces are sequentially and mechanically loaded into a handling clip, and the handling clips are sequentially and mechanically loaded onto to magazines which maintain the clips in a prescribed sequence until the next operation at which time they are delivered in said prescribed sequence.

Yet another object of the present invention is to provide an improved apparatus for storing fabric pieces in separate, spaced arrangement between processing operations in the cut and sew operation.

Other objects and a fuller understanding of the invention will become apparent from reading the following detailed description of a preferred embodiment along with the accompanying drawings in which:

FIG. 6 is a perspective view similar to FIG. 4, except showing the upper end of the empty clip magazine with the transport head in position for picking up an empty clip;

FIG. 11 is a sectional view of the handling clip taken substantially along lines 11—11 in FIG. 10.

DETAILED DESCRIPTION OF A PREFERRED EMBODIMENT

Figure 1:
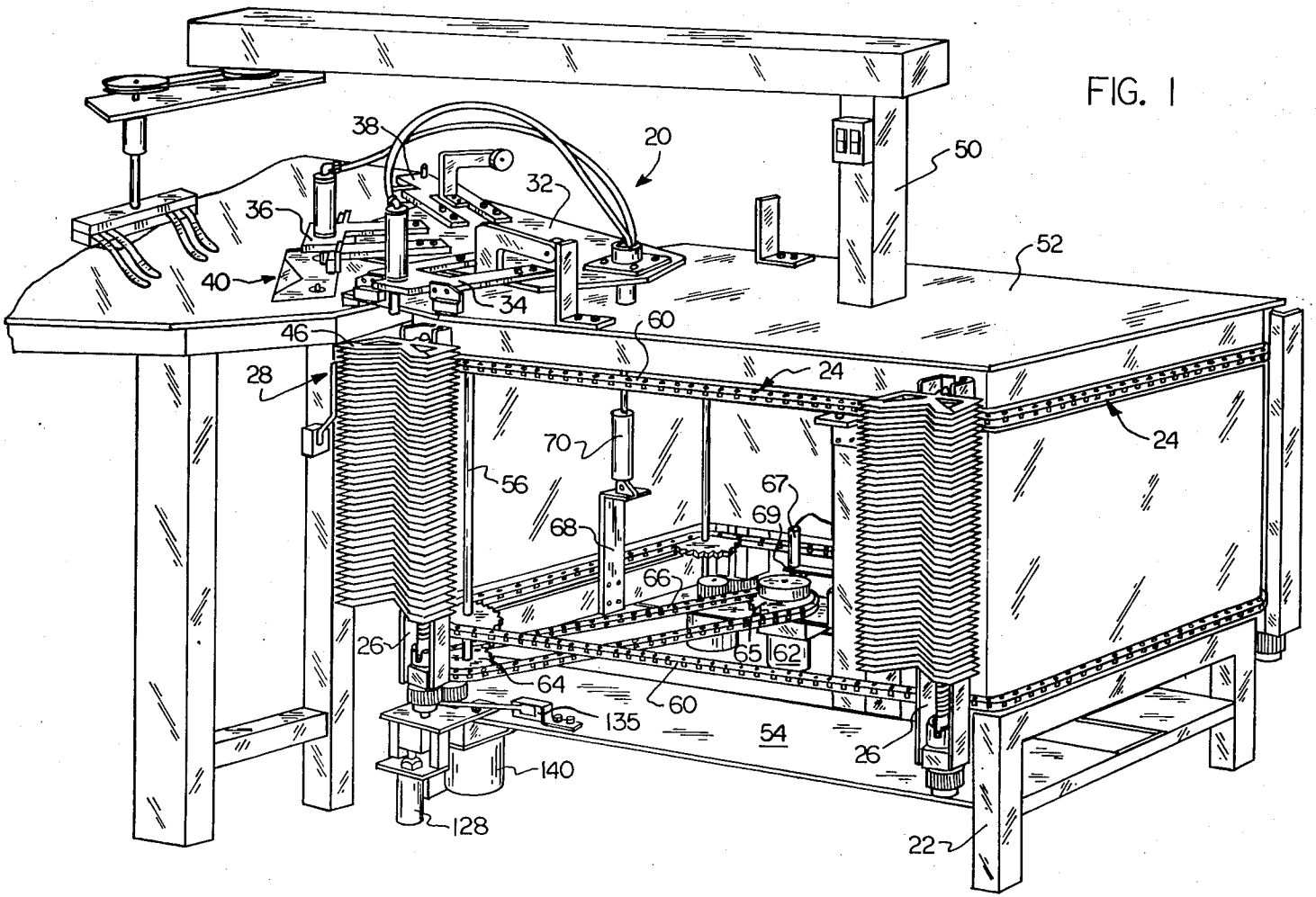
FIG. 1 is a perspective view of a magazine loader/-feeder apparatus according to the present invention with the transport turret attached and particularly illustrative of the empty clip supply station and the fabric piece station.
Figure 2:
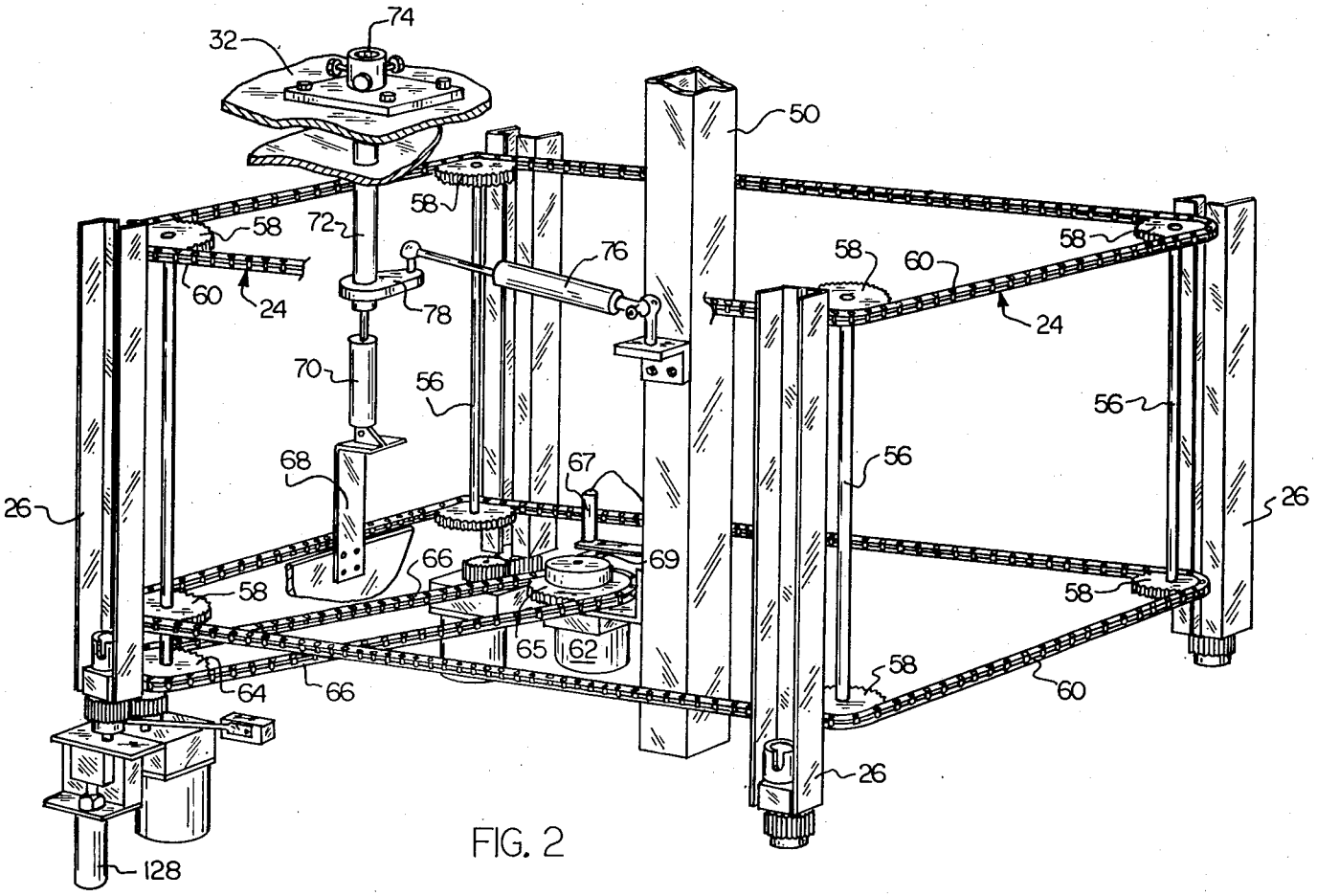
FIG. 2 is a perspective view similar to FIG. 1, except with the transport turret removed and with other parts broken away for the sake of clarity.
Figure 3:
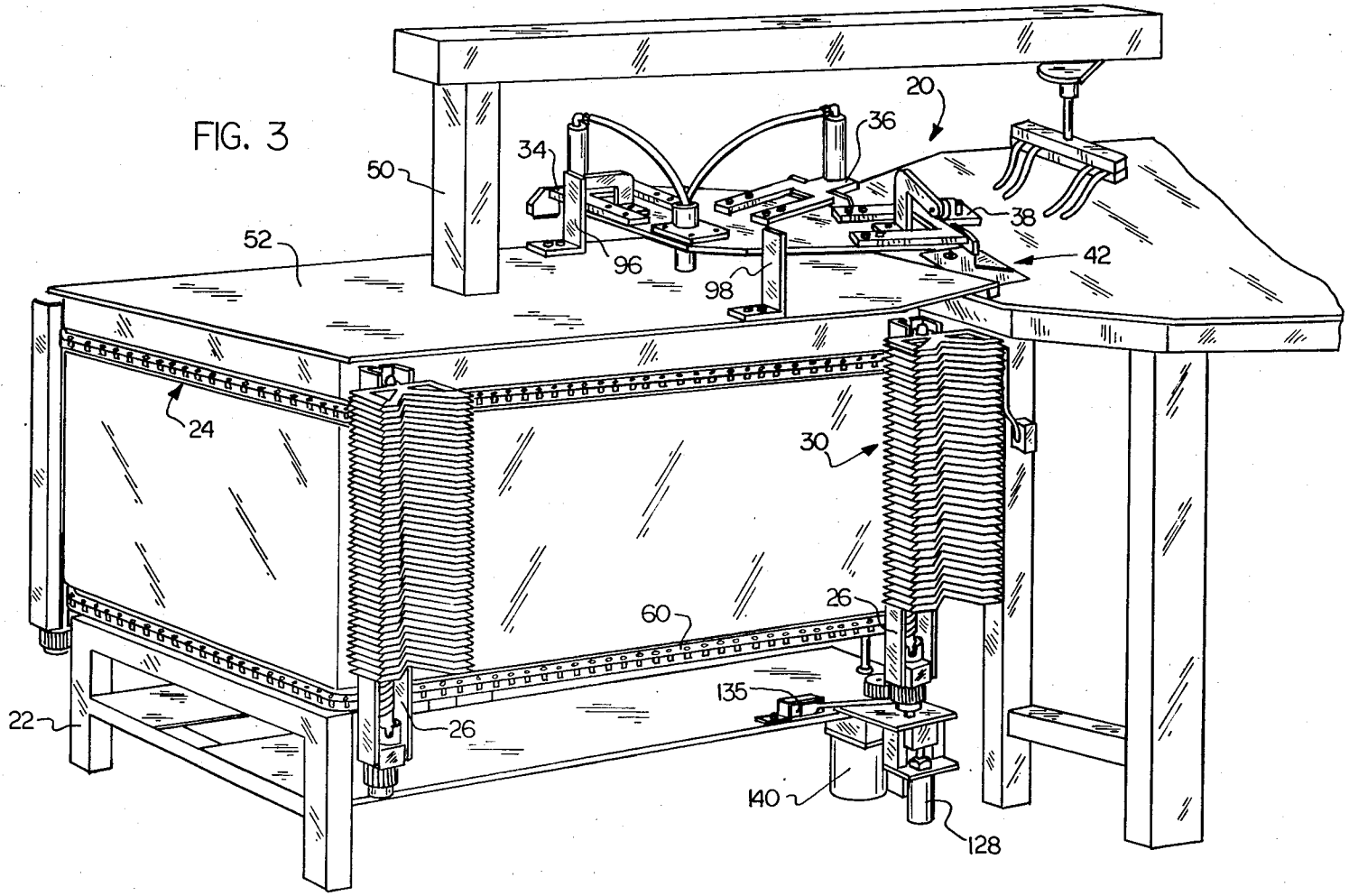
FIG. 3 is a perspective view similar to FIG. 1, except showing the opposite side of the loader/feeder apparatus with the transport turret removed and with other parts broken away and particularly illustrating the clip loading station.

Turning now to the drawings and particularly to FIGS. 1-3 there is illustrated a preferred embodiment of the loader/feeder apparatus 20 of the present invention. In its most general aspects, the loader/feeder apparatus 20 includes a base frame or housing 22 in which are housed the controls, drive motors, and on which are mounted substantially all of the operational components of the invention which will be described hereinafter. Such components include a conveying means 24 which support and carry a plurality of magazines 26 around the periphery of frame 22. In this way magazines carrying empty clips are first unloaded at an empty clip supply station 28. When the magazine 26 has been unloaded the conveying means 24 is indexed to the next position where the empty magazine is in position to be loaded with full clips. Once loaded, the conveyor means 24 is again indexed so that the loaded magazine 26 is moved to a position where an operator can remove the loaded magazine from the housing and replace it with a magazine full of empty clips for return to the empty clip supply station 28.

A transport turret 32 is pivotally mounted atop the housing 22 for reciprocal arcuate movement in a horizontal plane. So mounted the transport turret 32 moves a first transport head 34 back and forth between the empty clip supply station 28 and the fabric panel insertion station 40; the second transport head 36 reciprocates back and forth between the fabric panel insertion station 40 and an auxiliary station 42; and the third transport head 38 reciprocates back and forth between the auxiliary station 42 and the clip loading station 30.

Figure 4:
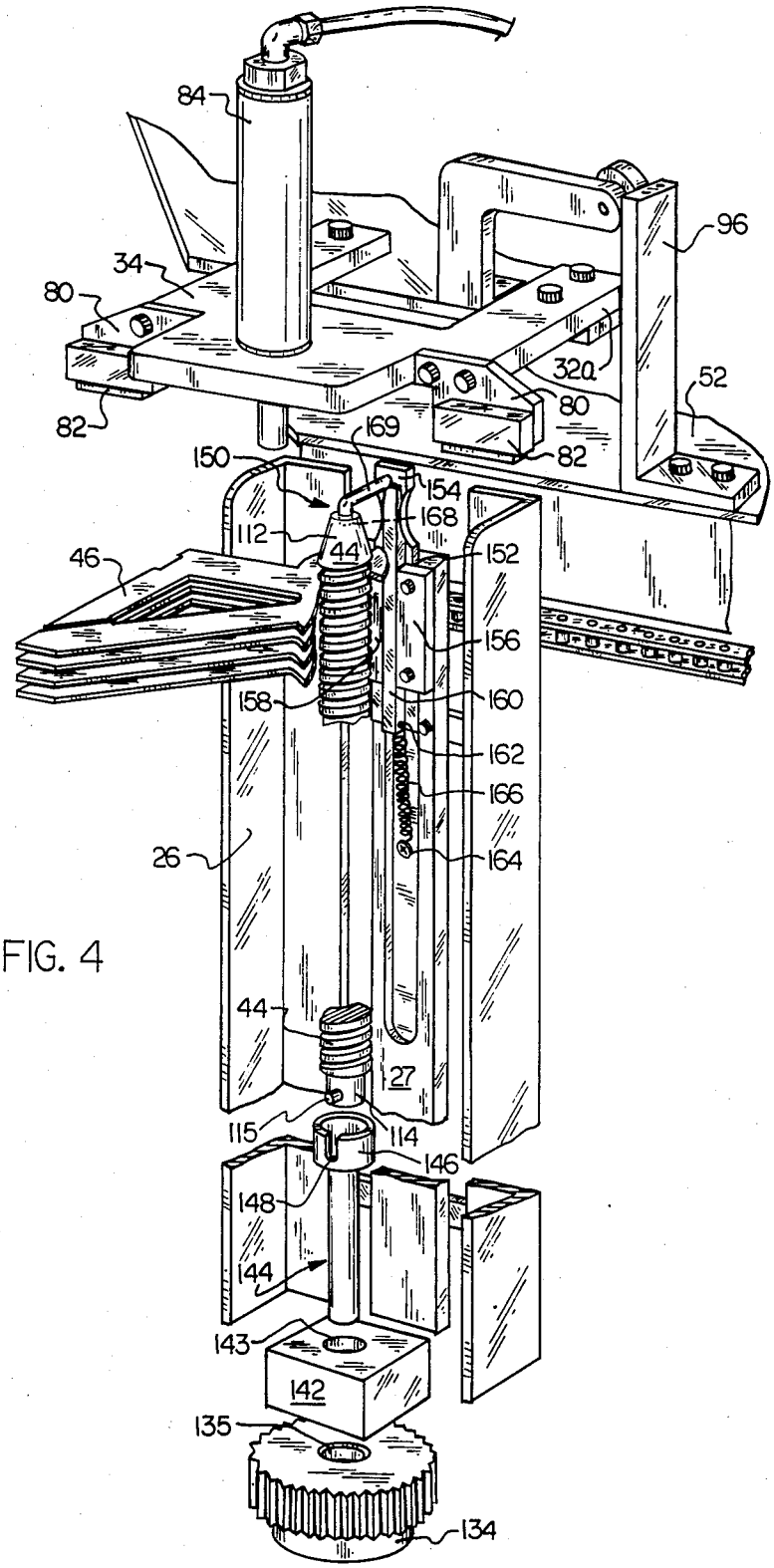
FIG. 4 is an enlarged perspective view illustrating an empty clip magazine and a portion of the corresponding transport head removed from the support frame and looking at the front and one side thereof.
Figure 5:
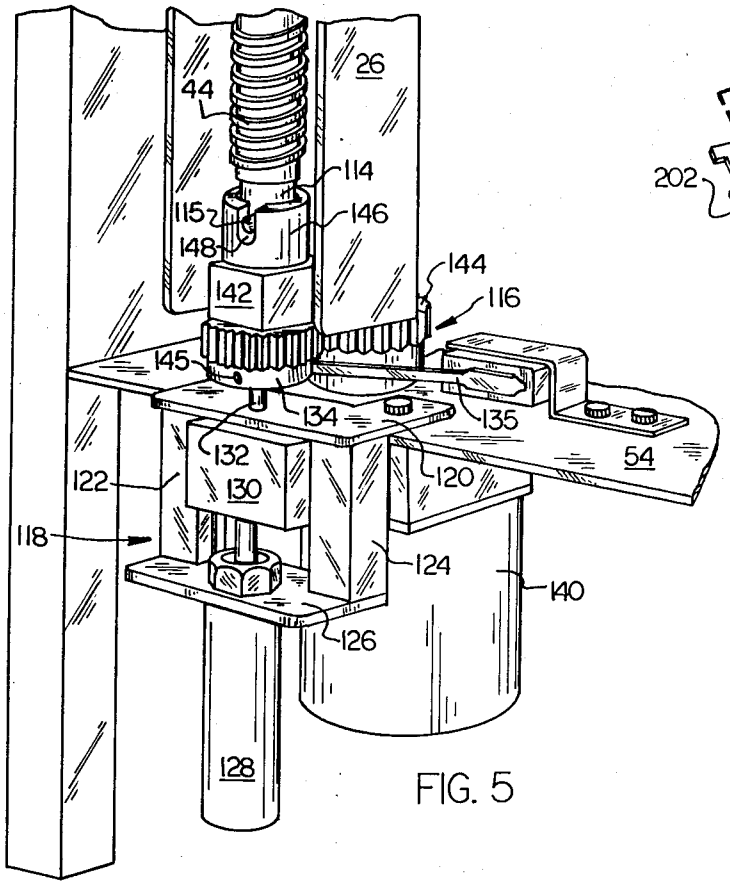
FIG. 5 is a perspective view similar to FIG. 4, except showing the rear side of the lower end of the empty clip magazine and the manner in which alignment of the magazine is insured, and the magazine is connected to the magazine drive motor.

Central to the present invention are the unique clip magazine 26 which carries a plurality of full or empty clips as best illustrated in FIGS. 4-6 and the unique fabric holding clip 46 illustrated in FIG. 11.

In the general operation of the loader/feeder apparatus 20, after fabric pieces, panels, or swatches such as pockets are cut to size and separated, either manually or as described in applicant's co-pending application Ser. No. 939,177, filed Dec. 8, 1986, entitled "SYSTEM FOR SEPARATING AND TRANSFERRING THE UPPERMOST FABRIC PLY FROM A STACK OF FABRIC PLIES," or in other conventional fabric ply separating devices, the pieces are successively presented to the loader/feeder apparatus 20 at the fabric piece insertion station 40. Empty clips 46 are successively removed mechanically from the threaded rod 44 of magazine 26 positioned in the clip supply station 28 and moved to the fabric panel insertion station 40 where each clip 46 is mechanically spread to receive a fabric ply. Once the clips 46 have been loaded with a fabric piece they are mechanically processed by the transport turret 32 past the auxiliary station 42 and on to the clip loading station 30, where they are loaded one at a time onto an empty magazine.

In accordance with the present invention, the clips 46 remain attached to the edge of the corresponding fabric panel during further storage, transportation, and processing of the fabric pieces until the corresponding fabric piece is joined to its next generation apparel assembly or subassembly. At intermediate points during the processing, the loaded magazines 26 may be presented to an unloader apparatus which is substantially the same as loader apparatus 20 operated in reverse. As the loaded clips are removed from the magazine, they may be inspected, further processed as by embroidering thereon, or attaching fabric or leather labels thereto, or presented to a further sewing operation during which time the fabric panels are sewed onto the ultimate garment or next subassembly. At such time the clip 46 may be of further use in that it provides a rigid handling instrumentality which may be easily and precisely registered or located at proper position for the next operation.

While the operational control program for sequentially operating the fluid actuators and electric motors is not shown and described in detail, it is believed to be well within the purview of a skilled artisan. For this reason, and since it is not critical to the uniqueness of the system, it is believed to be surplusage and will not be described further herein. Obviously there are many control programs which would suffice, it being necessary only that the proper components be activated and deactivated at an appropriate time.

Apparatus Support Housing

Looking primarily at FIGS. 1–3 the support frame or housing 22 includes a central stanchion or post 50 having attached thereto an upper wall 52 and a lower wall 54. Support rods 56 are journalled between the upper and lower walls 52,54 for rotation therebetween. Each support rod carries a pair of sprockets 58, one adjacent the upper end and one adjacent the lower end for supporting and moving the conveyor chain 60 around the periphery of housing 22. The aforesaid magazines 26 are equally spaced along the conveyor chains 60. The configuration of the main frame or housing 22 and spacing of the magazines 26 are such that at the end of each indexing sequence, one of the four magazines is positioned on a side wall immediately adjacent one of the corners thereof. Thus, the main frame 22 must be slightly longer than it is wide to allow the conveyor chains to wrap around the end walls and become positioned along the sides thereof.

A motor 62 having a vertically oriented output shaft 63 and drive sprocket 65 is mounted on lower wall 54 and connected to an auxiliary sprocket 64 on one of the corner support rods 56 by a drive chain 66. The effective circumference of drive sprocket 65 is equal to the spacing between housing 26. Thus, a single revolution of motor 62 causes the sprocket 64 to drive the conveyor means 24 a prescribed distance to move the magazine housings 26 from one position to the next. A photocell 67 "sees" a lug 69 on drive sprocket 65 to deactivate motor 62 after each revolution. The sprockets 58 of the other three support rods 56 merely serve as idler sprockets during the rotation thereof, as the driving of one of the support rods 56 will function to move the chain in the prescribed direction. The motor 62 may be driven in either direction to move the conveyor means 24 either clockwise or counterclockwise around frame 22.

A mounting bracket 68 is secured to a vertical wall of housing 22 between the forward support rods 56 and has mounted thereto a fluid driven (gas or hydraulic) lift actuator or cylinder 70 in vertical orientation. A hollow support column 72 is mounted to the free end of the piston of hydraulic lift actuator 70 and extends through an opening 74 in the transport turret 32. A second fluid driven actuator 76 is attached at the base thereof to the stanchion 50, while the piston thereof is operatively attached to an operating lever 78, which in turn is secured to the hollow support column 72.

So arranged, when the lift actuator 70 is activated the transport turret 32 is caused to raise or lower for reasons to be hereinafter described. Further, when the second actuator 76 is activated the hollow support column 72 is caused to rotate, thus causing the transport turret 32 to reciprocate arcuately in one direction or the other to either pick up empty clips or deliver full clips. It should be pointed out that the turret lift and rotating mechanisms are exemplary only, as many such arrangements would adequately serve the purpose.

The transport turret 32 is provided with three, generally radially extending, transport heads 34,36,38. Each transport head is provided with a pair of opposed arms 80, each of which carries a pick-up magnet 82. As the turret is lowered by the action of lift cylinder 70 in its first or clip pick-up position, the magnets 82 are moved close enough to either the uppermost clip 46 in a magazine or to a clip positioned at one of fabric panel insertion station 40 or auxiliary station 42 that the clip 46 comes within the magnetic field and becomes attached thereto. As the transport turret 32 is subsequently lifted by the action of lift cylinder 70, the clip 46 is lifted from its rest position. As the transport turret 32 is then indexed to its second or clip release position, the clip is also moved to the next station in the operation. As the transport turret 32 is again lowered the clip is moved into position for release at the next station. At this time there must be some means provided for releasing the clip from the magnetic attraction exerted by the magnets 82.

Figure 10:
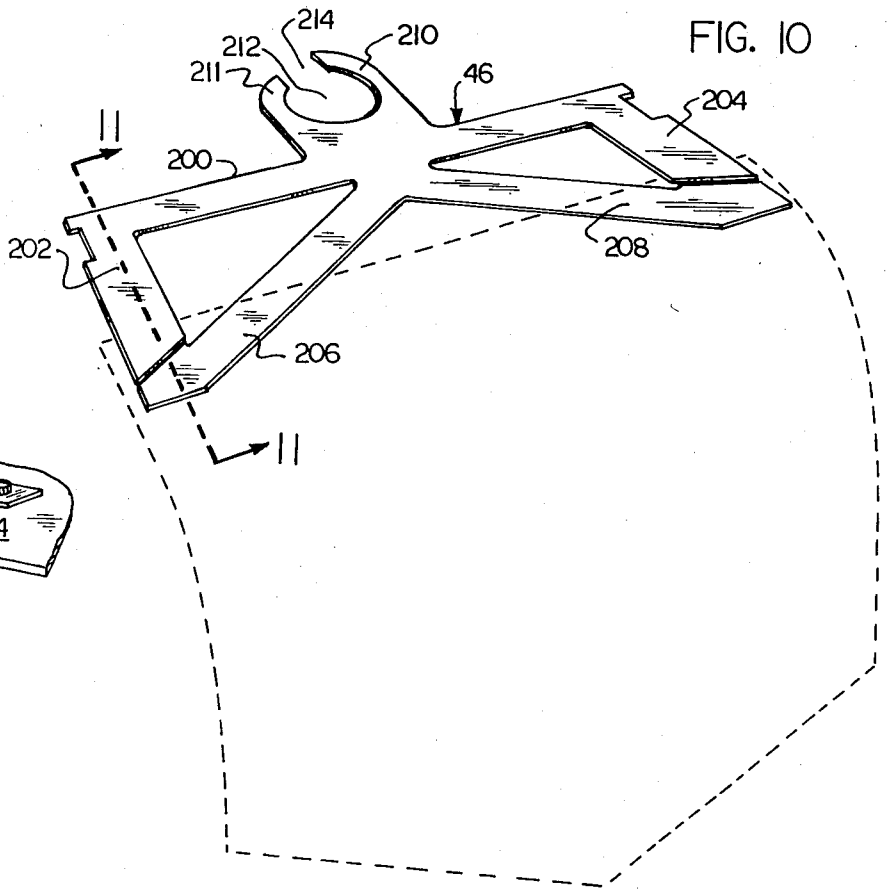
FIG. 10 is a perspective view of the handling clip itself, removed entirely from the apparatus.
Figure 9:
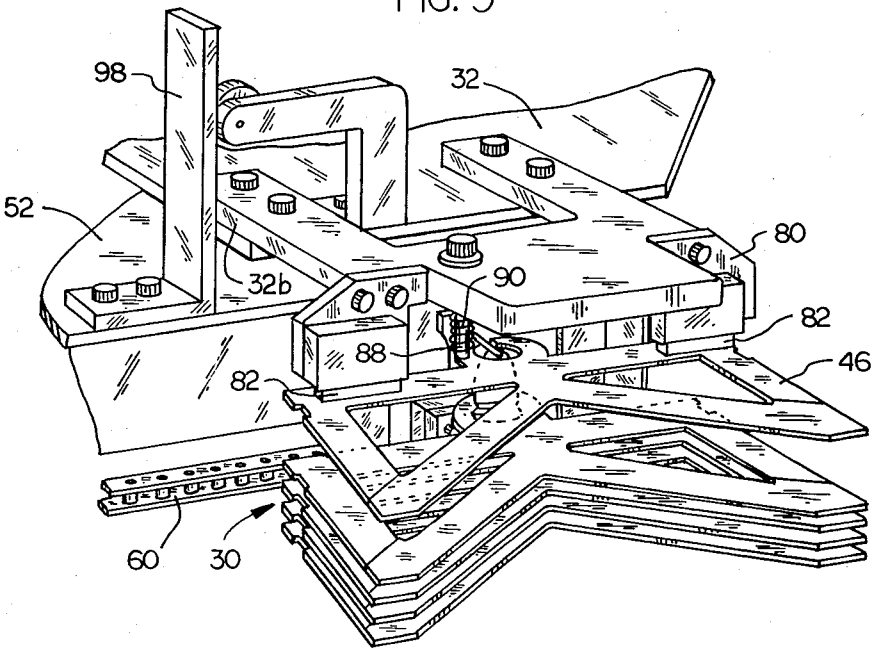
FIG. 9 is a perspective view of the upper end of clip loading station illustrating the transport head overlying the magazine and in position to deliver a full clip onto the receiving end of the magazine.

This release means is provided on transport heads 34,36 by a centrally mounted fluid actuator or cylinder 84 (in the case of transport head 34) and 86 (in the case of transport head 36). In the case of transport head 38 a downwardly extending spring biased rod 88 is mounted for vertical reciprocation between the central portion of the arms 80. A spring 90 surrounds the rod 88 to normally urge it toward its lowermost position. The operation of the cylinders 84,86 and the spring loaded rod 88 will be described later hereafter in connection with the discussion of FIGS. 9 and 10.

The transport turret 32 generally has two positions: a first clip pick-up and loading position and a second clip delivery or release position. A pair of guide brackets 96,98 extend upwardly from each side of housing 22, bracket 96 being adjacent the trailing edge **32*a* of transport turret in the clip pick-up and loading position, while bracket 98 is adjacent the leading edge 32*b* of transport turret 32 when the turret is moved to its clip delivery position. Each of the brackets provide a guide surface against which a roller bearing 100 from the adjacent transport head engages to ensure a vertical path of the transport turret 32** during its vertical movement.

Fabric Panel Retaining Clip

Looking at FIG. 11 there is illustrated the type of fabric panel retaining clip 46 envisioned for use with the present invention. The clip is preferably formed of spring steel and includes a body portion 200 having a pair of arms 202,204 extending downwardly from each end thereof. A pair of legs 206,208 are joined near the center of body portion 200 and diverge downwardly and outwardly therefrom to a position adjacent the free ends of arms 202,204. It should be understood that the free ends of the arms 202,204 are sheared or severed from the adjacent ends of legs 206,208 so that the arms can be spread to grip a fabric panel therebetween.

A pair of arcuate fingers 210,211 extend upwardly from the central portion of body member 200 and, in general, encircle an opening 212 through which the subsequently described threaded rods 44 are inserted to retain the clips in spaced arrangement on the magazines 26. The projections 210,211 do not completely encircle the opening 212, but a gap or space 214 is intentionally left therebetween for two reasons. One is to allow the clips to slip down over the magazine retaining bar 169 as will be hereinafter described. Secondly, the ends of projections 210,211 adjacent the gap 214 are bent upwardly (in the case of 210) and downwardly (in the case of 211) to form a cooperating configuration with the pitch of threaded rod 44. Thus, the amount of bend is determined by the size of the thread, the clips 46 being of a thickness approximately equal to or slightly less than the corresponding thread width of threaded rod 44.

Figure 7:
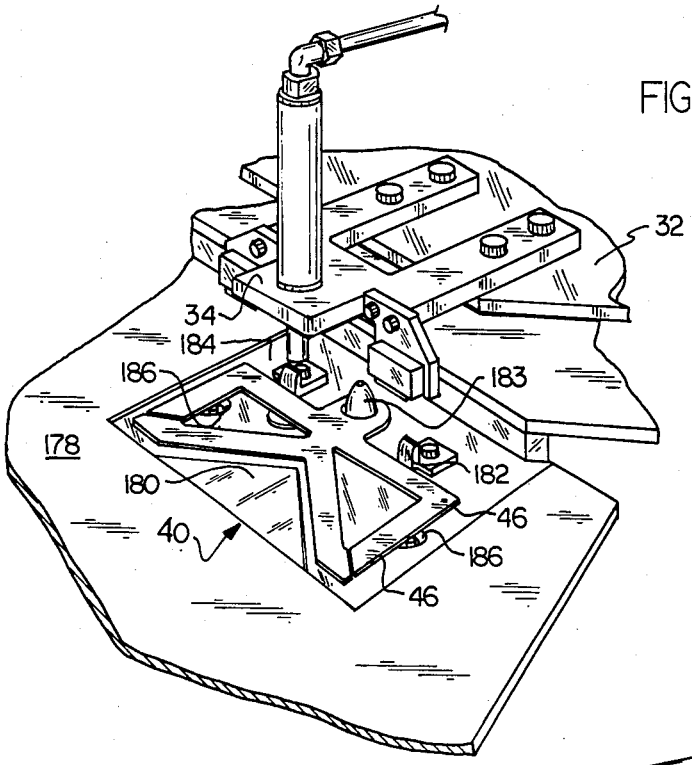
FIG. 7 is a perspective view of the fabric piece insertion station where an empty clip is activated and loaded with a fabric panel, and illustrating the clip in the relaxed position.
Figure 8:
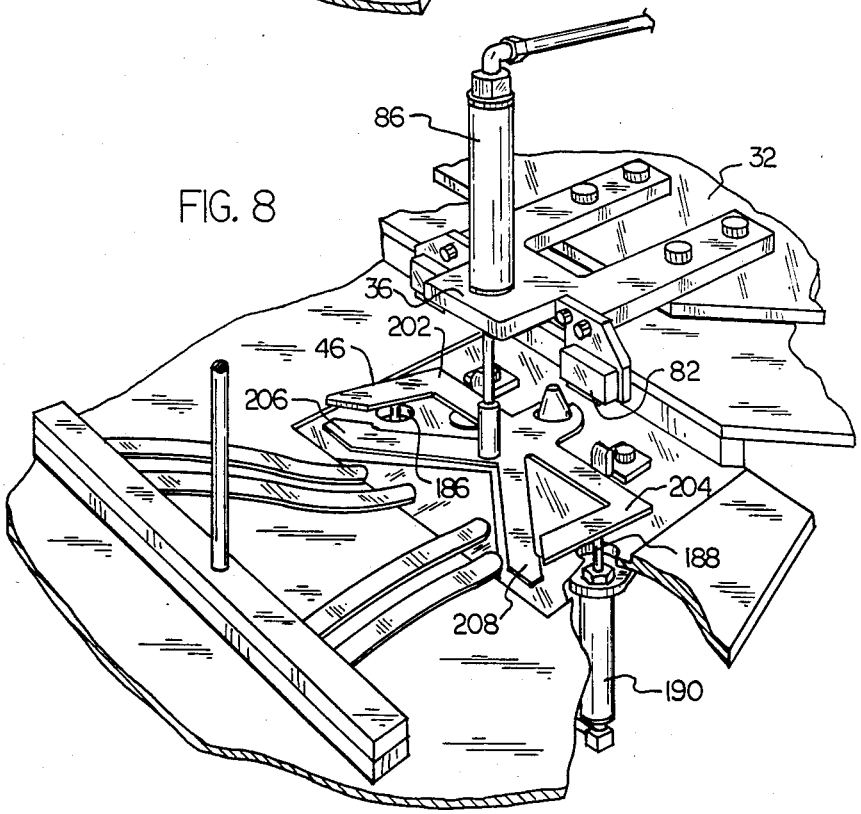
FIG. 8 is a perspective view similar to FIG. 7, except showing the clip moved to the open position in preparation for receiving a fabric panel between the arms and legs thereof.

As illustrated in FIGS. 7 and 8 in order to prepare the clip for the receipt of a fabric panel, arms 202,204 are lifted and bent upwardly, while legs 206,208 are held down to form a relatively large entrance for the fabric panels therebetween. When the fabric panel is inserted, the arms 202,204 and legs 206,208 are brought back together in clamping relationship with the fabric panel therebetween. The fabric panel thus stays tightly gripped between the adjacent edges of arms 202,204 and legs 206,208 of the clip 46 throughout the processing of the fabric panel for the reasons previously discussed. The clip construction illustrated in FIGS. 10 and 11 tightly grips fabric pieces regardless of their thickness because of the sharp edges 202*a*, 206*a*, even though the thickness of the spring steel body 200 is itself quite thin.

Empty Clip Supply Station

The clip supply station is best illustrated in FIGS. 4 and 5 and provides the point from which empty clips are fed from a magazine 26 one at a time to the fabric panel insertion station 40. In order to best describe the clip supply station it should first be pointed out that a magazine housing 26 is moved into position by the encircling conveying means 24 for unloading of empty clips 46. The magazine 26 itself is primarily comprised of a threaded rod 44 having a nose or bullet-shaped upper end 112. The lower end 114 is so configured as to attach to a rotational mechanism 116. For this purpose, the only structural alteration to the threaded rod is a set screw 115 that is inserted radially into the lower end 114 of the threaded rod 44. The set screw seats into a slot 148 in the rod mounting apparatus as will be hereinafter explained to transmit a rotational force from a rotational means 116 to the threaded rod 44.

The magazine rotating mechanism 116 in general includes an electric motor so arranged and operated as to induce one revolution of the threaded rod 44 during each sequence of operation. Looking at FIGS. 4 and 5, the magazine rotating mechanism 116 includes a gear 144 connected to the output shaft of motor 140, which gear 144 intermeshes with a drive gear 134, which couples the rotation of motor 140 to the threaded rod 44. A flat on the surface of drive gear 144 is in contact with a switch 135 to signal motor 140 at the completion of a revolution.

To stabilize and align threaded rod 44 within magazine 26, there is provided a housing 118 including a top wall 120, side walls 122,124, and a bottom wall 126 which, when assembled, form a rectangular open framework. The top wall 120 of housing is secured to the lower wall 54 of the apparatus housing 22 at a point on the conveying path defined by the clip supply station 28. A fluid actuator 128, such as an air cylinder or hydraulic cylinder, is attached to the bottom wall 126 with the piston thereof extending through an opening in said bottom wall into operative engagement with a lift block 130. A support pin 132 extends upwardly from lift block 130 through an opening in the top wall 120. As the lift block 130 is reciprocated upwardly and downwardly by the linear actuator 128, the support pin 132 is caused to move correspondingly upwardly and downwardly into engagement with the lower end of connecting rod which is not shown in FIG. 5, but which extends downwardly from the threaded rod mounting apparatus described hereinbelow. This corrects any misalignment of magazine 26 and maintains the magazine in proper position for the clip unloading operation.

The aforementioned rod mounting apparatus includes a bearing block 142, stationarily mounted in the magazine housing 26 adjacent the lower end thereof. A cup-shaped rod seat 146 includes a connecting rod (not shown) extending downwardly fromm seat 146 through an opening in the bearing block 142 for supporting the seat 146 in rotational relation thereto. The lower end of the connecting rod continues through an opening in a drive gear 134, and is secured in non-rotational relation thereto by a set screw 145. A slot 148 extends axially through the wall of the seat 146 for a distance of approximately one-half inch. This slot receives the set screw 115 in the lower end 114 of threaded rod 44.

So arranged, the lower end of connecting rod extending downwardly from seat 146 is so configured as to seat upon the pointed upper end of support pin 132, yet the pointed end allows rotation of the connecting rod with relation to the support pin 132. Further, the slot 148 provides a seat for the set screw 115 in the lower end of threaded rod 44. Thus, as the fluid actuator 128 is activated to extend the piston thereof, the lift block 130 is elevated bringing the pointed end of support pin 132 into engagement with the concave end portion in the lower end of connecting rod 144. This corrects and adjusts any misalignments of magazine 26 in the clip supply station. Activation of motor 140 then causes a rotation of seat 146 through the connecting rod within the bearing block 142. This rotational movement is transmitted to the threaded rod 44.

The upper end of housing 26 is provided with a magazine retaining means 150. For this purpose there is first provided a groove 152 in the base wall 27 of housing 26. A slide block 154 is slidably mounted within the groove 152 by means of stationary retaining blocks 156,158. A rib 160 extends outwardly between blocks 156,158 from the surface of slide block 154 and includes a transverse opening 162 at the lower end thereof. A screw or stud 164 is inserted in the groove or trough 152 at a point spaced from the slide block 154. A bias spring 156 connects the lower end of rib 160 with the stud 164 to continuously urge the slide block 154 in a downward direction.

An overlying rod retainer 168 extends outwardly from the upper end of slide block 154. As can be seen, since the slide block 154 and retainer 168 are normally biased in a downward direction, the retainer 168 will hold the upper end of the threaded rod 44 as it is inserted between the retainer 168 and the slotted seat 148 formed in the upper end 146 of connecting rod 144.

Normally the distance between the retainer 168 and slotted seat 148 is slightly less than the corresponding dimension on the threaded rod 144 forming the magazine 26. To seat the magazine 26 the set screw 115 is inserted in the slot 148 and the nose 112 is snapped beneath the retainer seat 168. While the retaining means holds the threaded rod in place it does not interfere with the normal rotation thereof during the unloading of clips 46.

The clips each contain an attachment means as previously described in connection with the description of FIG. 11. It will be sufficent to mention at this point that the fingers 210,211 fit over the threaded rod and include a slot or opening therein that provides an opening whereby the clip 46 may be slid down over the retainer support bar 169. The clip 46 is of such thickness that it fits within the threads of threaded rod 44. The fingers 210,211 are slightly bent upwardly and downwardly so that the rotation of a threaded rod 44 one revolution will move one clip upwardly and off the upper end of threaded rod 44.

As the clips are separately fed off the top of threaded rod 44, the aforesdescribed transport head 34 magnetically engages and lifts the clip responsive to the movement of the transport turret 32 upwardly, then laterally to the fabric panel insertion station 40.

Fabric Panel Insertion Station

Turning now to FIGS. 7 and 8 there is illustrated the fabric panel or clip loading station 40 in which a clip 46 is initially seated, activated to an open position, receives a fabric panel, clamps the fabric panel, and is lifted to move on to the next station.

Toward this end there is first provided an auxiliary table or work surface 178 underlying the periphery of the transport turret 32 at a point beneath the transport head 36 when the turret 32 is in the empty clip magazine unloading position and underlying transport head 34 when the turret 32 is in the full clip loading position. The work surface 178 includes a recessed clip seat 180 therein forming a clip seat base surface 184 below work surface 178. One or more locating abuttments 182 and a locating projection 183 which is very similar to the configuration of the magazine nose is provided in the clip seat for the proper positioning of empty clips as they are seated therein by the transport head 34.

A pair of spaced openings 186 and the recessed clip seat 180 provide passageways for pins 188 which normally underlie the side arms of clips 46. The pins 188 are vertically reciprocal and move from a first position below the surface of clips seat 180 to an extended position projecting through openings and lifting the side arms of clips 46 to a spread position in preparation for loading of the fabric panels therein. As the pins 188 are lifted by pin activators 190 (preferably air cylinders) the linear actuator 86 of transport head 36 is extended to engage the legs of clip 46 as illustrated in FIG. 8. At such time, the legs of clip 46 remain below the work surface 178 within the recessed clip seat 180 so that a fabric panel sliding across the work surface will move into the entrance between the legs 206,208 and lifted arms 202,204 of the clip 46 without interference.

Once the fabric panel is positioned within clip 46 the pins 188 and fluid actuator 86 are retracted and the clip then clamps the fabric panel securely therein. The turret 32 is then lowered until the magnets 82 grasp the opposed arms of clip 46 so that as the turret 32 is again elevated, the clip 46 is lifted along with the fabric panel loaded therein for movement to the next station.

It should be noted here that the fabric panels may be loaded into the clip 46 manually or by some type of fabric panel separating and moving instrumentality which does not form a part of the present invention. Further, the loaded clip is moved by transport head 36 to the auxiliary station 42 where the clip is again lowered and removed from the transport head in the same manner as previously described onto any appropriate type of seat with locating abutments and projections thereon to properly orient the clip as it is seated. Again, the lift cylinder 86 is extended to break the magnetic hold on the clips 46 as the turret is lifted to leave the clip 46 in position at the auxiliary station 42 as the turret is returned to its home position.

Full Clip Loading Station

As the third transport head 38 transfers a full clip to the clip loading station the magazine housing 26 with the magazine 44 therein is moved to a position on housing 22 which is almost identical with the clip supply station. The clip loading station 30 includes a second rotational means 116 substantially identical with the rotational means on the opposite side of housing 22. For this purpose there is provided another fluid actuator 128, lift block 130, drive motor 140, all of which operate in the same way to selectively rotate the threaded rod 44 one revolution per operational sequence. The only difference here is that the threaded rod 44 is rotated in the opposite direction to load clips rather than pushing clips off the upper end of the threaded rod 44. In order to facilitate the loading operation the spring biased release rod 88, which extends downwardly from the central portion of transport head 38, engages a surface portion of the clip 46 as it is initially presented to the upper end of threaded rod 44. The spring biased release rod 88 remains in engagement with the clip as the transport turret is lifted slightly to break the magnetic hold of magnets 82 on the clip 46 being loaded. At this time, the threaded rod 44 is actuated by its drive motor 140. The release rod 88 actually pushes the clip 46 down onto the threaded rod 44 as it rotates to initially start the loading operation. The loading of the magazine 26 at the clip loading station continues until the magazine 26 is full, whereupon the conveyor means 24 is indexed to the next position, where the loaded magazine 26 may be removed and/or replaced by a magazine carrying empty clips.

Mechanical Operation of the Apparatus

The steps of processing a single clip through the different stations of the machine have been previously described hereinabove. It would also be helpful to discuss the sequential operation of the machine itself as it processes multiple clips simultaneously. First of all, assume that one magazine 26 of empty clips has been emptied at the clip supply station 28 and a magazine 26 of fabric loaded clips has been filled at the clip loading station 30. The motor 62 is then activated to index the magazine housings to the next station. The previously discussed photocell 67 senses the position of the indicator lug 69 on the periphery of the drive sprocket 65 to sense the completion of a revolution of the motor sprocket.

The housings 26 have now been moved into their approximate desired location. The magazine housing alignment mechanism is then activated by extending the positioning pin 132 of the linear actuator 128, which moves the adjacent magazine housing 26 into proper position and steadies it for the loading and feeding operation to follow.

At this time the transport turret 32 is in the first or the clip pick-up position with transport head 34 being aligned with and above a clip supply station 28; transport head 36 being above and aligned with the fabric panel insertion station 40; and transport head 38 being aligned with and above the auxiliary station 42.

Simultaneously, at the fabric panel insertion station 40, pneumatic cylinders 190 are extended to move the lift pins 188 through the openings 186 and elevate arms 202,204. During this time the linear actuator 86 is extended to bear against the intersection of legs 206,208 and hold them down while arms 202,204 are lifted to fabric panel receiving position. Once the fabric panel is inserted, the activators 190 are retracted to cause the arms 202,208 to grip the fabric panel from above, whereupon the cylinder 86 is retracted to release the pressure against the leg 206,208.

As the turret lowers, the clips 46 at each of the aforesaid stations 28,40,42 become attached to the magnets 82. The turret is lowered, as previously described by the lift actuator 70. Once the magnets 82 have captured the clips from stations 28,40,42, the transport turret 32 is again elevated carrying the clips 46 attached to transport heads 34,36, and 38. The linear actuator 76 is then activated to retract the piston thereof and through operating arm 78 attached to hollow support column 72, the turret is rotated clockwise to the second or clip deposit position.

As the transport turret 32 reaches the second or clip deposit position, the linear actuator 70 is again retracted to lower the turret 32. At the bottom of this stroke, the clips 46 held by transport heads 34,36, and 38 become properly positioned at the fabric panel insertion station 40, the auxiliary station 42, and the clip loading station 30 respectively. Prior to the time the lift cylinder 70 is extended to lift the transport turret 30 the pistons of cylinder 84,86 are extended in such manner that when the transport turret 32 is lifted, the magnetic force between the magnets 82 and the clips 46 is broken and the clips 46 are left in their proper seated position as the turret 32 is elevated. Additionally, at the same time the spring loaded release rod 88 urges the clip 46 held on the transport head 38 down onto the upper end of the threaded rod 44 at the clip loading station where it is properly seated by rotation of the rod 44, as previously described.

When the transport head 32 is returned to its upper position the linear actuator 76 is then extended and again, through operating arm or lever 78 attached to hollow support column 72, the transport turret 32 is rotated counterclockwise back to the first or clip pick-up position. This cycle is repeated until either the clip supply magazine at station 28 is empty, or the clip loading magazine at station 30 is full, whereupon the motor 62 is again activated to move the magazine housings 26 to the next position.

While a preferred embodiment of the invention has been described in detail hereinabove, it is apparent that various changes and modifications might be made without department from the scope of the invention as set forth in the accompanying claims.

What is claimed is:

1. Method for processing fabric pieces during a cut and sew operation in the manufacture of apparel or similar textile goods comprising the steps of:

(a) separating and presenting cut fabric pieces successively to a clip insertion station in a prescribed sequence;

(b) releasably attaching a rigid handling clip to each of said fabric pieces;

(c) maintaining each of said clips with its corresponding fabric piece and transporting said fabric pieces by engagement of automated equipment with said clips rather than with said fabric pieces during further storage, transportation, and processing until said fabric piece is joined to its next generation apparel assembly or sub-assembly.

2. The method according to claim 1 and further including after step (b) the step of loading a plurality of said clips into a clip magazine in said prescribed sequence for storage and transportation to the next processing station.

3. The method according to claim 1 and further including the step of positioning said fabric pieces for subsequent operations by automatically locating said rigid clips in a sewing fixture with the pieces attached to said clips to properly position said fabric pieces.

* * * * *